US006563929B2

(12) United States Patent
Kim

(10) Patent No.: US 6,563,929 B2
(45) Date of Patent: May 13, 2003

(54) WOOFER HAVING ORNAMENTAL FLASHING LIGHTS

(75) Inventor: Lae Chang Kim, Kowloon (HK)

(73) Assignee: American Hi-Fi Industrial 26, Inc., Vernon, CA (US)

( * ) Notice: Subject to any disclaimer, the term of this patent is extended or adjusted under 35 U.S.C. 154(b) by 0 days.

(21) Appl. No.: 09/927,833

(22) Filed: Aug. 10, 2001

(65) Prior Publication Data

US 2003/0031330 A1 Feb. 13, 2003

(51) Int. Cl.[7] ..... H04R 3/00
(52) U.S. Cl. ..... 381/117; 281/396; 281/401
(58) Field of Search ..... 381/111, 117, 381/394, 396, 386, 400, 401, 423, 403; 181/198, 195

(56) References Cited

U.S. PATENT DOCUMENTS 4,220,832 A * 9/1980 Nagel ..... 381/401
4,860,370 A * 8/1989 Grosbard ..... 381/403
6,137,891 A * 10/2000 Porrazzo ..... 381/423

* cited by examiner

*Primary Examiner*—Minsun Oh Harvey
(74) *Attorney, Agent, or Firm*—Morland C. Fischer

(57) ABSTRACT

A woofer that is capable of producing a flashing light show depending upon the volume and frequency of the sounds emitted thereby. The woofer includes at least one light emitting diode and a control circuit that are conveniently mounted on a printed circuit board at the center of the woofer at an inconspicuous location below a transparent dust cover so as to achieve a compact configuration without effecting the aesthetic appearance of the woofer. The woofer also includes a magnetic structure having at least one permanent magnet and at least one electromagnetic voice coil that is adapted to move in first and opposite directions towards and away from the permanent magnet depending upon the changing polarities of an alternating current that is supplied to the electromagnetic voice coil. An inside cone from a hollow shell that emits sounds to a listener is coupled to the electromagnetic voice coil so as to move in the first and opposite directions with the electromagnetic voice coil and thereby provide the listener with a powerful dynamic effect.

10 Claims, 4 Drawing Sheets

WOOFER HAVING ORNAMENTAL FLASHING LIGHTS

BACKGROUND OF THE INVENTION

1. Field of the Invention

This invention relates generally to speakers and, more particularly, to a woofer that is capable of producing a dynamic flashing light show depending upon the volume and frequency of the sound to be emitted thereby.

2. Background Art

A woofer is a well known type of speaker that reproduces audio sounds that are usually first amplified by an audio amplifier. However, the ornamental appearance of conventional woofers is independent of the sounds that are emitted therefrom. That is to say, the appearance of the woofer does not change regardless of the frequency and volume of the sounds that are heard by a listener. Therefore, the conventional woofer is, in and of itself, completely passive and has no effect on the emotions or feelings of the listener.

In certain cases, it has been known to associate an ornamental light emitting diode (LED) display with a speaker. Such speakers typically have control circuitry located on an exterior surface thereof. Since the LEDs are usually located far from the control circuitry, such LEDs require complicated circuitry having many connections which has heretofor resulted in malfunctions. In some cases, signal delays are introduced which cause the flashing light effect produced by the LEDs to be out of sync with the sound (e.g. music). In cases where the LEDs are placed around the outside of the speaker, the appearance of the speaker is often negatively effected. What is more, installation of these speakers is complicated in areas where little space is available, such as in a motor vehicle. Consequently, the conventional speakers having a flashing light capability are characterized by a large size, an undesirable crowded appearance and a flashing light display which does not always track the volume and/or frequency of the emitted sounds.

One example of a woofer which has a flashing light capability is available by referring to U.S. Pat. No. Des 442,945 issued May 29, 2001.

SUMMARY OF THE INVENTION

A woofer is disclosed having either one or two LEDs and a control circuit that are conveniently mounted on a printed circuit board at the center of the woofer at an inconspicuous location under a transparent dust cover so as to achieve a compact configuration without effecting the aesthetic appearance of the woofer. The woofer receives an AC input from the output of an audio amplifier. A diode rectifier transforms the AC input into a DC voltage for driving the LEDs. Accordingly, the LEDs are capable of generating a flashing light show depending upon the output of the audio amplifier and the volume and frequency of the sounds that are reproduced by the woofer.

The woofer includes a hollow shell that surrounds the printed circuit board on which the LEDs and control circuitry are mounted. The hollow shell has an inside cone and an outside frame that are joined together at a resilient (e.g. rubber) lip that extends around the outermost edge of the shell. The inner cone of the shell is attached (e.g. glued) to a voice coil housing that lies below the dust cover so as to enclose the LED printed circuit board. A single voice coil or dual voice coils are wound around the voice coil housing. The woofer has a magnetic structure including a T-yoke to carry a plurality of permanent magnets and an inner core around which the voice coil housing is slidably received. The voice coil, which is connected to AC input terminals of the woofer, receives an alternating current, such that when the polarity of the voice coil and the permanent magnets are identical, the voice coil will be attracted towards the permanent magnets. In this case, the voice coil housing around which the voice coil is wound will slide downwardly over the inner core of the magnetic structure so as to pull the resilient lip around the woofer shell radially inward. When the plurality of permanent magnets and the voice coil are at opposite polarities, the voice coil will be repelled by the magnets. In this case, the voice coil housing will slide upwardly over the inner core to push the resilient lip of the woofer shell radially outward. Accordingly, a dynamic push-pull magnetic effect is created that causes the woofer shell to be compressed and expanded in a manner that tracks the sounds being emitted by the woofer.

DETAILED DESCRIPTION

Figure 2:
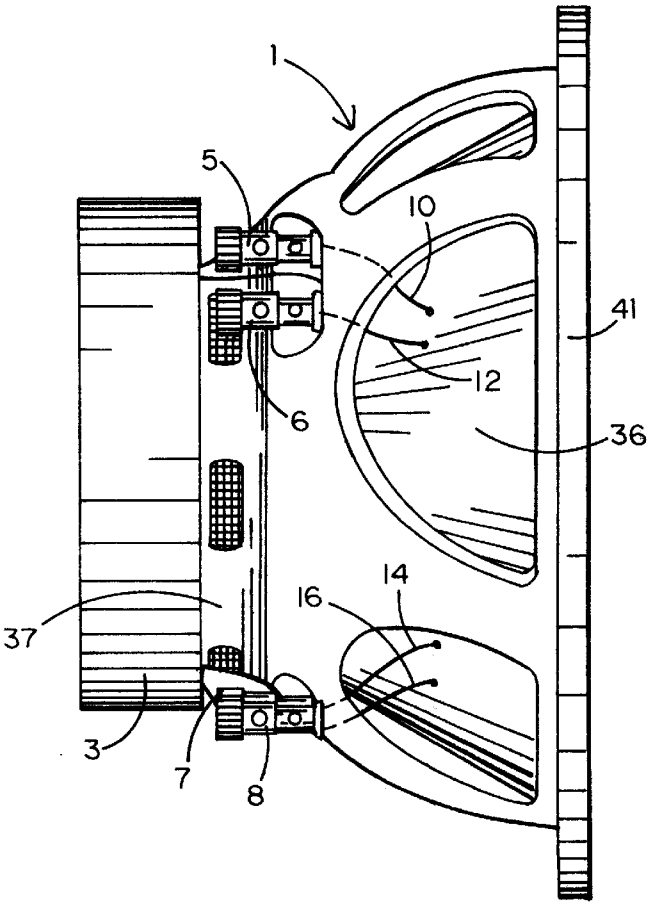
FIG. 2 is a side view of the woofer shown in FIG. 1.
Figure 1:
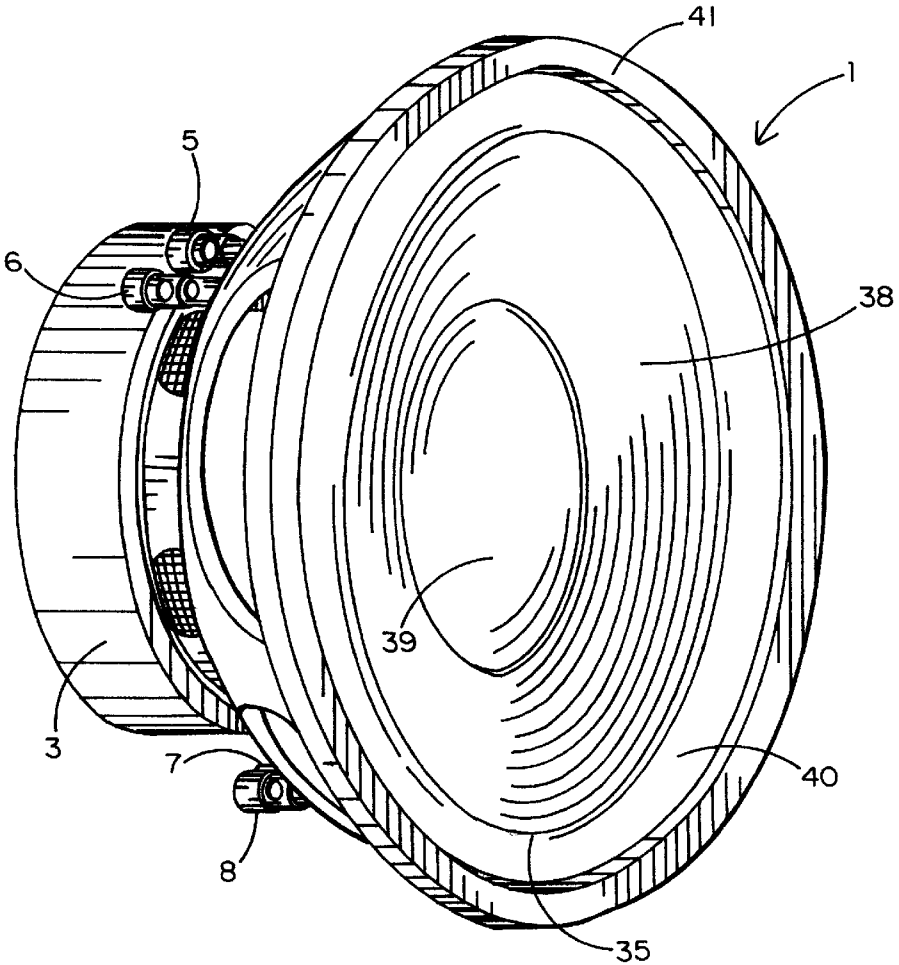
FIG. 1 shows the woofer of the present invention that is adapted to produce a dynamic flashing light show depending upon the volume and frequency of the sounds emitted thereby.

FIGS. 1 and 2 of the drawings show the woofer 1 of the present invention that is adapted to provide a flashing light show that tracks the amplitude and frequency of the sounds to be emitted therefrom. The woofer 1 includes a non-metallic base 3 that encloses a magnetic structure (designated 42 in FIGS. 3 and 4). The woofer 1 is shown having two pairs of AC input terminals 5, 6 and 7, 8, although the advantages of this invention are also available by using only one pair of AC input terminals. The input terminals 5, 6 and 7, 8 are to be connected to receive an AC voltage from the AC output of an audio amplifier (not shown). As will be explained while referring to FIGS. 3–7, the AC input to the woofer 1 is rectified to a DC voltage in order to drive one or more LEDs (designated 32 and 32-1 in FIGS. 3 and 4) that are inconspicuously located at the center of the woofer 1 below a transparent dust cover 39 so as to consume little space without effecting the aesthetic appearance of the woofer.

Figure 3:
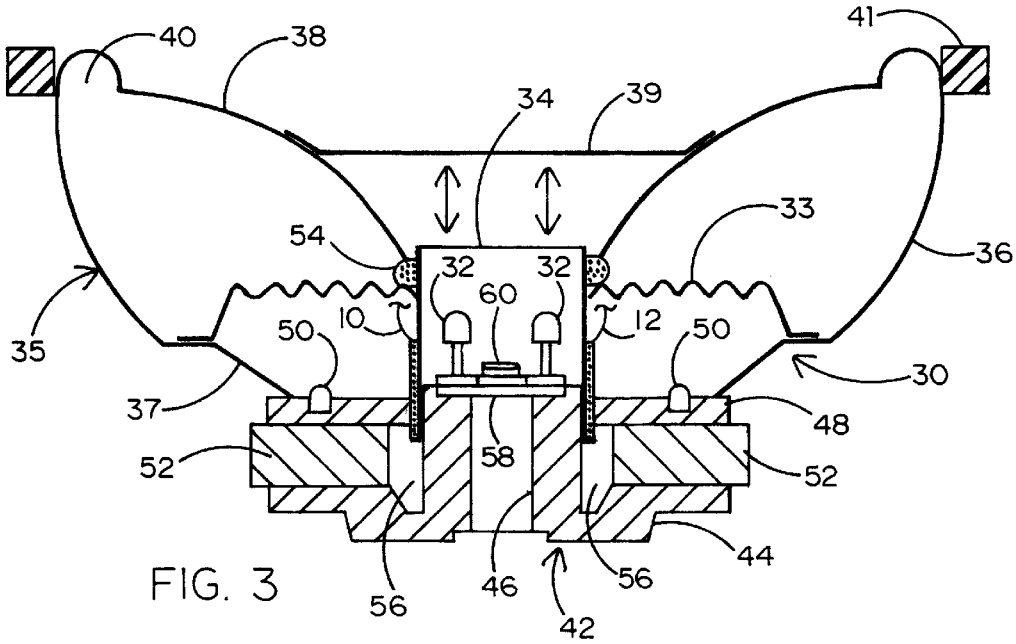
FIG. 3 is a cross-section of the woofer of FIG. 1 having a pair of flashing light emitting diodes and a single voice coil.
Figure 4:
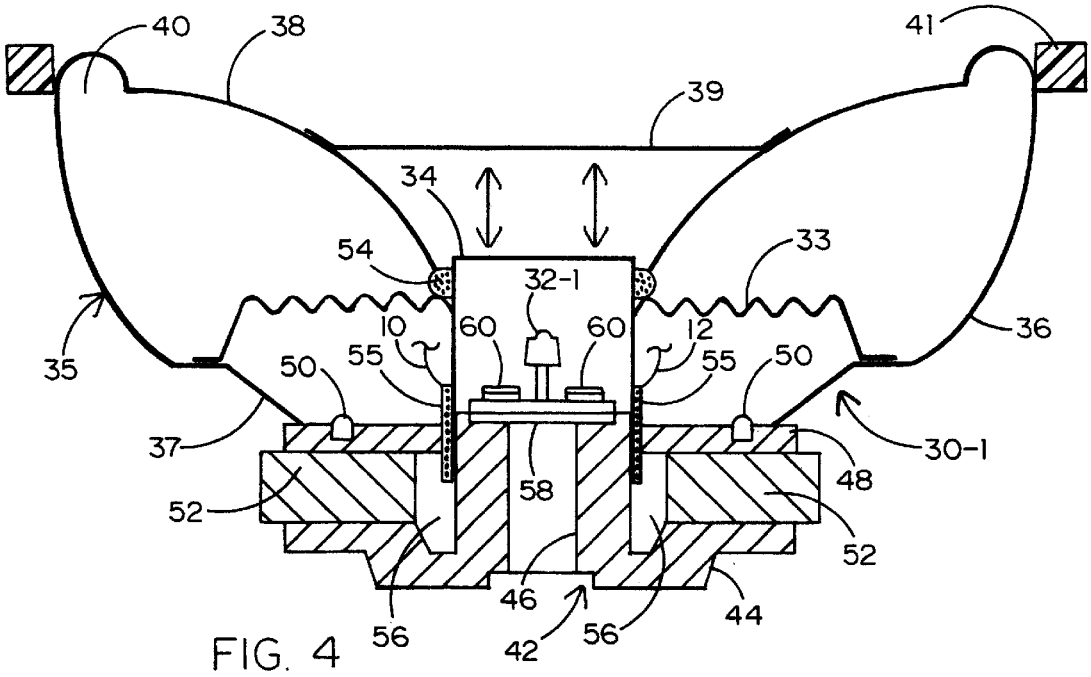
FIG. 4 is a cross-section of the woofer of FIG. 1 having a single flashing light emitting diode and a pair of voice coils.

The dust cover 39 extends across an elastic inside cone 38 that is spaced from an outside frame 38 of a hollow shell 35 (best shown in FIGS. 3 and 4). The inside cone 38 is joined to the outside frame 36 at a resilient lip 40 that extends around the outermost edge of the shell 35. The lip 40 of shell 35 is surrounded by a relatively hard (e.g. plastic) rim 41 that extends circumferentially around the shell 35 of woofer 1. As will now be disclosed, the elastic inside cone 38 of shell 35 surrounded by rim 41 will repeatedly collapse inwardly and expand outwardly in response to a push-pull magnetic effect in order to provide the woofer 1 with a dynamic appearance that also tracks the sounds emitted by woofer 1.

FIGS. 3 and 4 of the drawings illustrate woofers 30 and 30-1 like that shown in FIGS. 1 and 2 having the capability of generating a flashing light show. The woofer 30 of FIG. 3 is provided with a pair of light emitting diodes (LEDs) 32 that are surrounded by a transparent voice coil housing 34 at the center of woofer 30. In the embodiment shown in FIG. 3, the voice coil housing 34 is cylindrical in shape and adapted to be displaced relative to a soon to be described magnetic structure 42 of woofer 30. A voice coil 55 is wrapped around the bottom of the voice coil housing 34. Although a single voice coil 55 is shown in FIGS. 3 and 4, a dual voice coil winding may also be wrapped around the bottom of voice coil housing 34. The voice coil 55 is connected by wires 10 and 12 (best shown in FIG. 2) to a first pair of AC input terminals 5 and 6. A second voice coil (not shown) would be connected by wires 14 and 16 (of FIG. 2) to a second pair of AC input terminals 7 and 8.

The woofer 30 includes a hollow, conically shaped shell 35 having an outside frame 36 and an inside cone 38 that lie in surrounding coaxial alignment with the voice coil housing 34. The inside cone 38 of shell 35 is manufactured from a foam-like elastic material, such as polypropylene, or the like. The outside frame 36 of shell 35 is attached to the magnetic structure 42 of woofer 30 by way of a conical base 37. The inside cone 38 of shell 35 is affixed to the voice coil housing 34 by means of a glue seam 54. A force damping spider 33 that engages the outside frame 36 of shell 35 is affixed to voice coil housing 34 at the glue seam 54 so as to reduce the transmission of motion generated forces therebetween. A transparent dust cover 39 extends across the center of the inside cone 38 of shell 35 above the transparent voice coil housing 34 so as to permit the light generated by LEDs 32 to be visible therethrough.

The outside frame 36 and inside cone 38 of shell 35 are joined to one another at a resilient (e.g. rubber) lip 40 that surrounds the outermost edge of the shell 35. Surrounding the elastic lip 40 of shell 35 is a circumferentially extending rim 41 of woofer 30 that is manufactured from a rigid material, such as plastic, or the like.

The magnetic structure 42 of woofer 30 includes a non-conductive (e.g. steel) T-yoke 44. The T-yoke 44 has a hollow inner cylindrical core 46 and an outer magnet support ring 48 surrounding core 46. The outside frame 36 of shell 35 is fixedly suspended above the top of the magnet support ring 48 of magnetic structure 42 by means of the aforementioned conical base 37 and suitable fasteners (e.g. screws) 50. In this manner, and as will soon be described, the inside cone 38 of shell 35 is adapted to be displaced relative to the outside frame 36. To this end, the bottom of the voice coil housing 34 around which the voice coil 55 is wrapped is slidably received around the cylindrical core 46 of T-yoke 44.

The outer magnet support ring 48 of T-yoke 44 carries a plurality of permanent (e.g. ferrite) magnets 52. The permanent magnets 52 and the voice coil 55 of FIGS. 3 and 4 are spaced from one another by an air gap 56. Seated on top of and coaxially aligned with the hollow inner core 46 of T-yoke 44 so as to lie within the voice coil housing 34 is a ring-shaped printed circuit board 58. Mounted around the ring-shaped printed circuit board 58 of the woofer 30 of FIG. 3 is the pair of LEDs 32 and the control circuitry (to be described in greater detail hereinafter when referring to FIGS. 5–7) by which to drive the LEDs 32 from a DC voltage. Printed circuit board 58 is attached to the inner core 46 of T-yoke 44 by mounting screws 60, or the like.

The manner in which the foam-like inner cone 38 of shell 35 is displaced relative to the outside frame 36 thereof is now described while continuing to refer to FIGS. 3 and 4. As previously described when referring to FIGS. 1 and 2, the woofers 30 and 30-1 are powered by an AC voltage. A corresponding alternating current is conducted through wires 10 and 12 to the voice coil 55 that is wrapped around the voice coil housing 34. Accordingly, the voice coil 55 will become an electromagnet having a polarity that changes with the alternating current.

When the polarity of the electromagnetic voice coil 55 is opposite the polarity of the permanent magnets 52, an attractive magnetic field is established therebetween. In this case, the voice coil housing 34 to which the voice coil 55 is attached will be caused to slide along the inner core 46 of T-yoke 44 in a direction towards permanent magnets 52. Inasmuch as the elastic inside cone 38 of shell 35 is attached to the voice coil housing 34, a pulling force is applied to the resilient lip 40 of shell 35 via the inside cone 38. Accordingly, the elastic inside cone 38 will collapse towards the outside frame 36, and the resilient lip 40 at the outermost edge of shell 35 will be pulled radially inward and away from circumferentially extending rim 41 of woofer 30. The spider damper 33 running across the shell 35 between the outside frame 36 and voice coil housing 34 opposes the compressive force that is generated in response to the movement of the inside cone 38 so that the outside frame 36 will remain substantially stationary.

When the polarity of the AC powered electromagnetic voice coil 55 changes so as to be identical to the polarity of the permanent magnets 52, a repelling magnetic field is established therebetween. In this case, the voice coil housing 34 will be caused to slide in an opposite direction along the inner core 46 of T-yoke 44 so as to move away from the permanent magnets 52. The inside cone 38 of shell 35 will now expand and the resilient lip 40 at the outermost edge of shell 35 is pushed outwards and towards the rim 41 of woofer 30. In this regard, it may be appreciated that the constantly alternating polarity of the voice coil 55 produces a push-pull magnetic effect, whereby to cause a compression and expansion of the shell 35 such that the elastic lip 40 thereof repeatedly moves back and forth relative to the position of the rim 41 so as to create a dynamic woofer effect in combination with a flashing light show.

FIG. 4 of the drawings shows a woofer 30-1 having a shell 35 and a magnetic structure 42 that are identical to those of the woofer 30 in FIG. 3. Therefore, like reference numerals have been used to identify identical components in FIGS. 3 and 4. In the case of FIG. 4, the woofer 30-1 includes a single LED 32-1 on printed circuit board 58 as opposed to the pair of LEDs 32.

Figure 5:
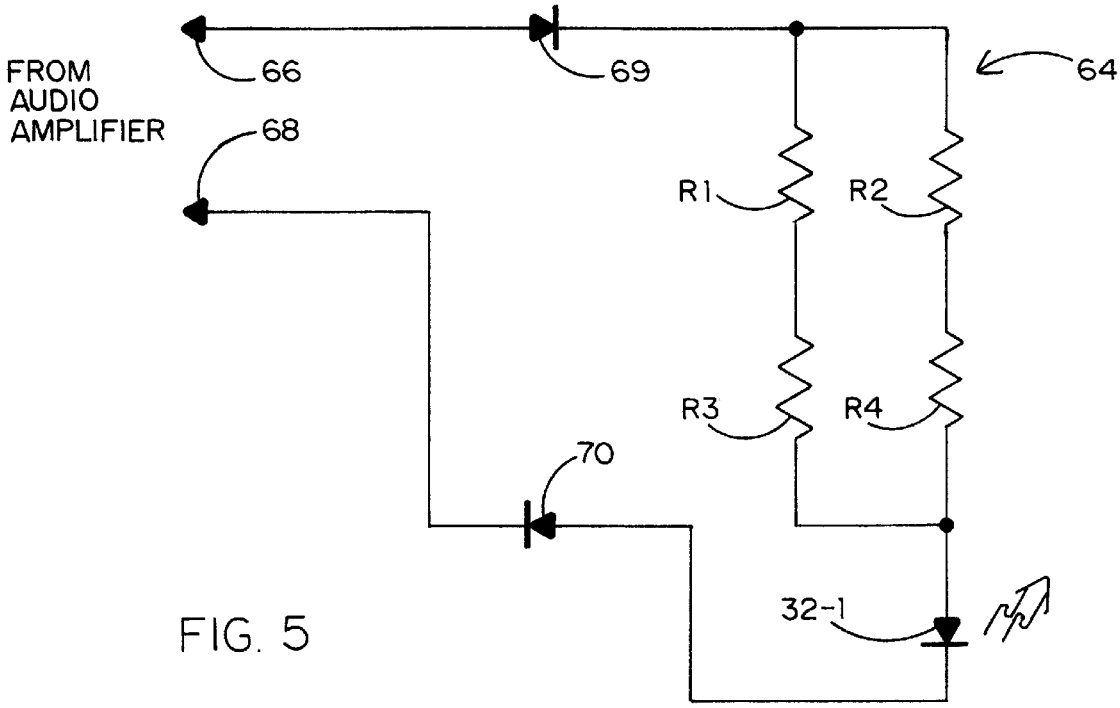
FIGS. 5–7 show electronic circuits for converting an AC input voltage to a DC voltage by which to drive the light emitting diodes from the woofers of FIGS. 3 and 4.

FIG. 5 of the drawings illustrates an AC circuit 64 by which to drive a single LED such as that designated 32-1 for the woofer 30-1 of FIG. 4. The circuit 64 has a single pair of AC input terminals 66 and 68 and a diode rectifier to drive LED 32-1. The circuit 64 will be used for a woofer having a single voice coil (designated 55 in FIG. 4). The input terminals 66 and 68 of circuit 64 are connected to receive AC audio output signals from an audio amplifier (not shown). The circuit 64 includes a pair of rectifying diodes 69 and 70 that transform the input AC voltage to a DC voltage to drive LED 32-1. Each rectifying diode 69 and 70 is respectively connected between an AC input terminal 66 and 68 and one terminal of LED 32-1. A conventional resistor bridge, comprising resistors R1–R4, is connected between rectifying diode 69 and LED 32-1.

Figure 6:
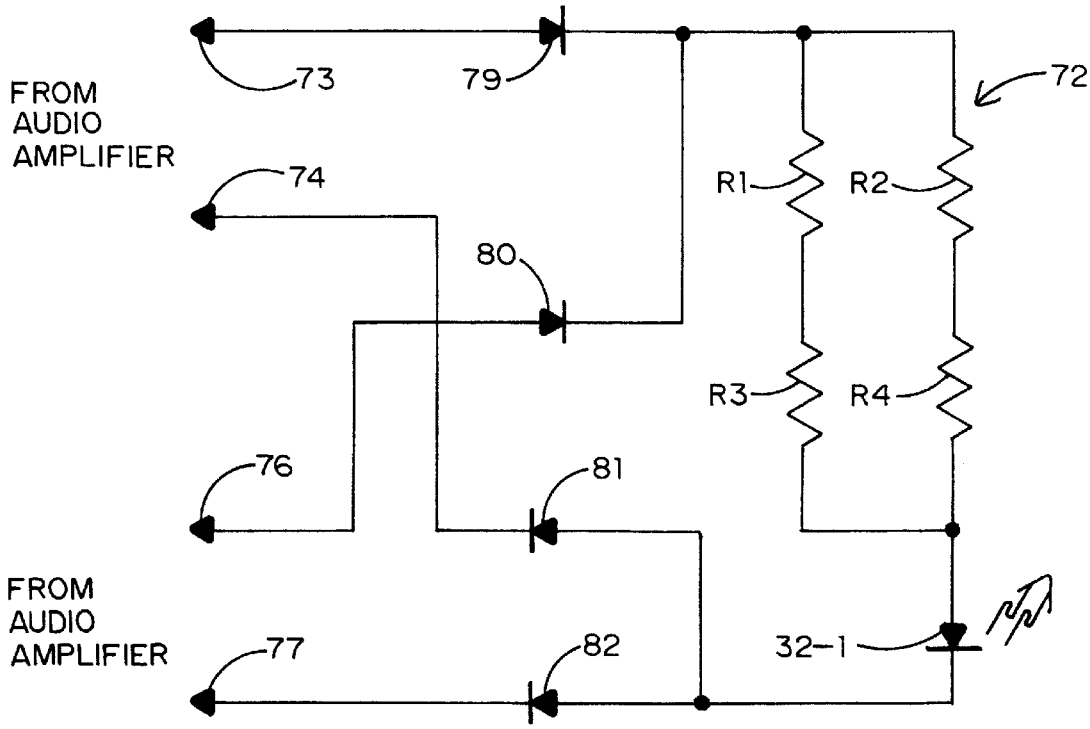

FIG. 6 of the drawings illustrates another AC circuit 72 by which to drive a single LED 32-1. In this case, the circuit 72 has two pairs of AC input terminals 73, 74 and 76, 77. What is more, the circuit 72 is adapted for use in a woofer having dual voice coils (not shown). Each pair of input terminals 73, 74 and 76, 77 is connected to a corresponding pair of AC audio output terminals from an audio amplifier (not shown). The circuit 72 includes a four diode, full rectifier bridge, comprising rectifier diodes 79–82, that transforms the input AC voltage to a DC voltage to drive LED 32-2. A conventional resistor bridge, comprising resistors R1–R4, is connected between one output terminal of the diode rectifier bridge and LED 32-2.

Figure 7:
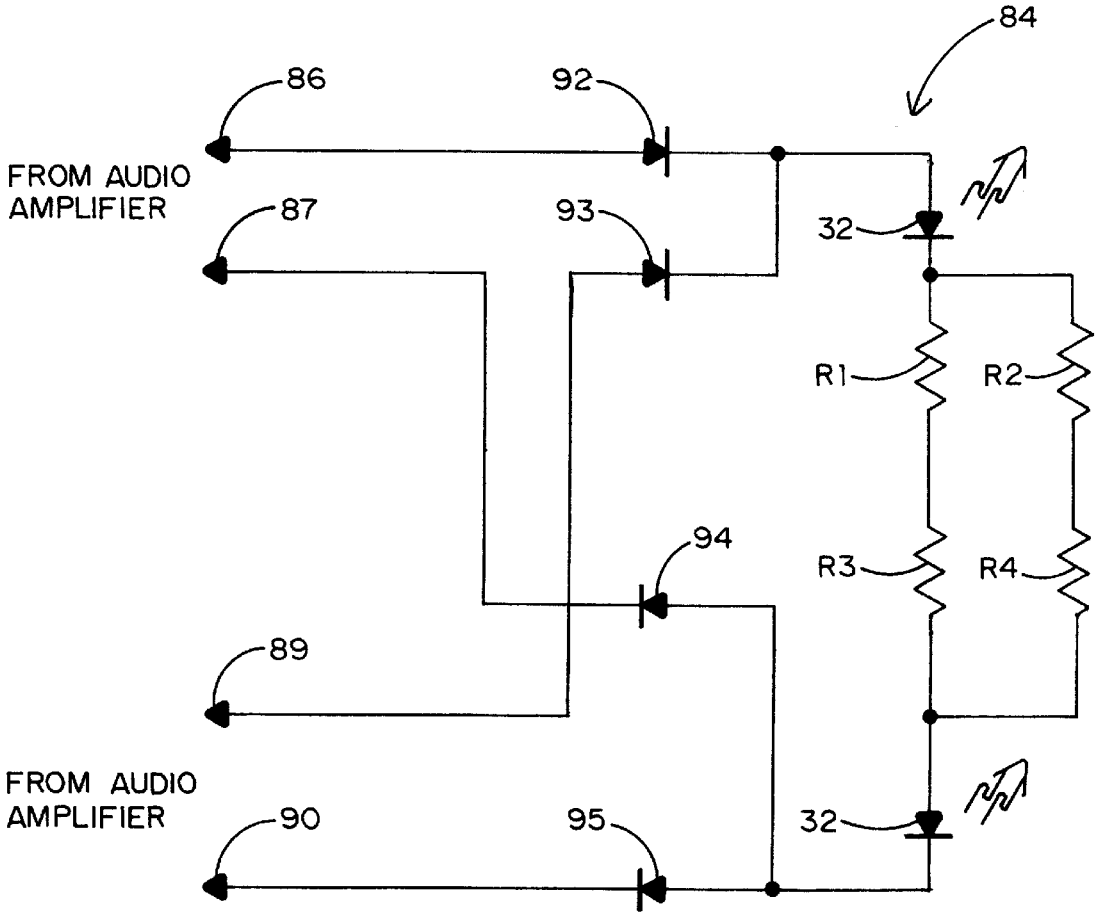

For increased brightness, FIG. 7 of the drawings illustrates another AC circuit 84 by which to drive a pair of LEDs, such as those designated 32 in FIG. 3. Like the circuit 72 of FIG. 6, the AC circuit 84 of FIG. 7 has two pairs of AC input terminals 86, 87 and 89, 90 and a four diode, full rectifier bridge, comprising diodes 92–95, that transforms the AC voltage from input terminals 86, 87 and 89, 90 to a DC voltage to drive LEDs 32. The LEDs 32 are connected in electrical series with one another, and a conventional resistor bridge, comprising resistors R1–R4, is connected in the series path between the LEDs 32.

Because the LEDs 32 and 32-1 of the circuits 64, 72 and 84 of FIGS. 5–7 are driven by rectified AC audio output signals from an audio amplifier, the brightness of the LEDs will be controlled by the output power of the audio amplifier. Moreover, the LEDs will flash only where there is an audio output signal from the audio amplifier. That is to say, to enhance the decorative effect provided at the center of the woofers 30 and 30-1 of FIGS. 3 and 4, the frequency and magnitude of the flashing light show produced by the LEDs will vary with the volume and frequency of the sound to be reproduced by the woofers. What is more, the light visible to a listener can be selectively controlled depending upon the value of the resistors R1–R4 of the resistor bridges in circuits 64, 72 and 84. Because the LEDs and their control circuits are housed on a printed circuit board that is located at the center of the shell 35, a compact and aesthetically pleasing woofer is now available to provide the listener with a powerful feeling. By virtue of the foregoing, the listener will be treated to a dynamic flashing light show that tracks the sounds that are emitted from the woofer.

I claim:

1. A woofer to receive an AC input signal from the audio output of an audio amplifier, said woofer comprising:

a magnetic structure including at least one permanent magnet and at least one voice coil spaced from said permanent magnet, said voice coil receiving an alternating current so as to become an electromagnet having polarities that change with the changing polarities of the alternating current; and a hollow conical shell from which sounds are emitted to a listener, said hollow conical shell having an outside frame fixedly attached to said magnetic structure and an inside cone coupled to said voice coil, said electromagnetic voice coil being pulled towards said permanent magnet when the polarities of said permanent magnet and said electromagnetic voice coil are opposite such that the inside cone of said hollow shell is displaced in a first direction, and said electromagnetic voice coil being pushed away from said permanent magnet when the polarities of said permanent magnet and said electromagnetic voice coil are identical such that said inner cone is displaced in an opposite direction.

2. The woofer recited in claim 1, wherein said magnetic structure also includes a non-conductive T-yoke having a cylindrical inner core and an outer ring surrounding said inner cylindrical core, the outside frame of said hollow conical shell fixedly attached to the outer ring of said T-yoke, and the cylindrical inner core of said T-yoke located at the center of said hollow conical shell in concentric alignment with each of the outside frame and the inside cone thereof and the outer ring of said T-yoke.

3. The woofer recited in claim 2, wherein said at least one permanent magnet is carried on the outer ring of said T-yoke and said electromagnetic voice coil is movable in said first and opposite directions along the cylindrical inner core of said T-yoke when said electromagnetic voice coil is pulled towards and pushed away from said permanent magnet.

4. The woofer recited in claim 3, further comprising a cylindrical voice coil housing slidably received on the cylindrical inner core of said T-yoke, said at least one voice coil being wrapped around said voice coil housing such that said voice coil housing slides in said first and opposite directions along said inner core when said electromagnetic voice coil is pulled towards and pushed away from said at least one permanent magnet.

5. The woofer recited in claim 4, including at least one light emitting diode to provide a flashing light display depending upon the frequency and the loudness of the sounds that are emitted by said hollow conical shell.

6. The woofer recited in claim 5, wherein said at least one light emitting diode is carried on a printed circuit board, said printed circuit board seated upon the cylindrical inner core of said T-yoke within said cylindrical voice coil housing.

7. The woofer recited in claim 6, further comprising an optically transparent dust cover spaced from said voice coil housing and extending across the inside cone of said hollow conical shell.

8. The woofer recited in claim 6, wherein said printed circuit board seated upon the cylindrical inner core of said T-yoke also carries electronic control circuitry for driving said at least one light emitting diode.

9. The woofer recited in claim 8, wherein said electronic control circuitry carried on said printed circuit board includes a rectifier for converting said AC input signal from the audio output of the audio amplifier to a DC voltage for driving said at least one light emitting diode.

10. The woofer recited in claim 9, wherein said rectifier for converting said AC input signal to a DC voltage for driving said at least one light emitting diode is a diode rectifier.

* * * * *